United States Patent [19]

Brennecke et al.

[11] 4,447,302

[45] May 8, 1984

[54] HIGHLY POROUS ELECTRODES HOT PRESSED FROM NICKEL POWDER FOR ALKALINE WATER ELECTROLYZERS

[75] Inventors: Peter W. R. Brennecke, Braunschweig; Henning Ewe, Hamburg; Eduard W. Justi, Braunschweig, all of Fed. Rep. of Germany

[73] Assignee: Bomin Bochumer Mineralol GmbH & Co., Fed. Rep. of Germany

[21] Appl. No.: 352,886

[22] Filed: Mar. 1, 1982

[30] Foreign Application Priority Data

Mar. 11, 1981 [DE] Fed. Rep. of Germany ..... 3109183

[51] Int. Cl.[3] ..... H01M 4/88; C25B 11/06

[52] U.S. Cl. ..... 204/128; 204/129; 204/290 R; 264/61

[58] Field of Search ..... 204/284, 290 R, 128, 204/129; 252/425.3; 429/44, 45; 264/61

[56] References Cited

U.S. PATENT DOCUMENTS 3,414,438 12/1968 Linkholm ..... 429/45
3,959,014 5/1976 Bauer et al. ..... 429/45
4,289,650 9/1981 Gray ..... 252/425.3

FOREIGN PATENT DOCUMENTS 290407 1/1979 Fed. Rep. of Germany .

OTHER PUBLICATIONS

Revue Internationale d'Heliotechnique 1979.

*Primary Examiner*—John F. Niebling
*Attorney, Agent, or Firm*—Salter & Michaelson

[57] ABSTRACT

The invention concerns a highly porous electrode of special construction and hot-pressed or sintered from nickel powder with the addition of a catalyst and a method for its manufacture. The electrode is characterized by catalytic promotion and long term stabilization by means of an addition of Ti and/or the formation of a surface layer of a stable mixed Ni-Ti oxide so that, when it is used for the electrolysis of water in alkaline electrolytes, the production of the gases of electrolysis takes place with the lowest possible polarization even at high current densities and that it retains its catalytic properties even at high temperatures of the electrolyte or during long times of operation. Because of its favorable properties, the use of the electrode is not limited to water electrolysis technology but is also possible in other technical fields of application such as, for example, the electrolysis of alkali chlorides or the hardening of fats. The electrode can be used both as an anode and a cathode.

10 Claims, 1 Drawing Figure

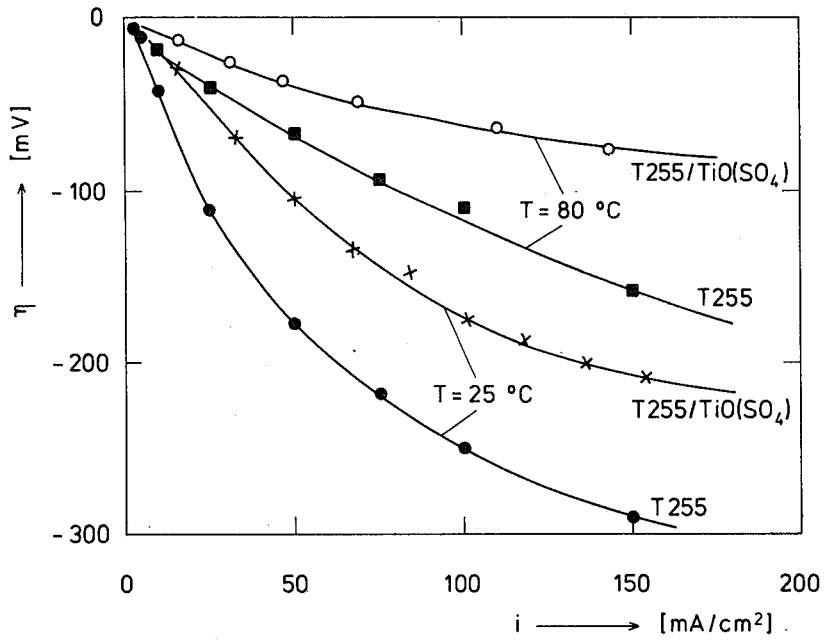
0
- 100
- 200
- 300
η [mV]
0
50
100
150
200
i [mA/cm²]
T255/TiO(SO4)
T = 80 °C
T255
T = 25 °C
T255/TiO(SO4)
T255

HIGHLY POROUS ELECTRODES HOT PRESSED FROM NICKEL POWDER FOR ALKALINE WATER ELECTROLYZERS

FIELD OF THE INVENTION

The invention relates to a highly porous electrode hot pressed from nickel powder for alkaline water electrolysers and in particular to an electrode which is coated on its internal and external surfaces with a coat of $NiO_x$ of thickness 0.0025–0.1 μm (10–100 molecular layers).

DESCRIPTION OF THE PRIOR ART

In a known electrode of the type described a high resistance to corrosion in strongly alkaline electrolytes is produced by a layer which consists almost entirely of NiO. The supporting lattice of Ni is protected by the layer of NiO, in particular against oxidation to voluminous oxides or hydroxides. In this way the working life of the electrode is lengthened significantly. In addition the liberation of $O_2$ is catalysed by this layer of NiO (DE-OS No. 29 03 407).

It is an object of the invention to provide an electrode of the type described in the introduction of this Specification which exhibits an improved catalytic effect in comparison with the known electrode and by means of which liberation of $H_2$ and $O_2$ takes place with low polarisation even at high current densities. In addition, the long term stability is increased by reducing the oxidation of the nickel of the electrode body, since, even with a coating consisting substantially of NiO, oxidation still proceeds slowly.

SUMMARY OF THE INVENTION

This object is solved according to the invention in that the surface layer consisting of a mixed Ni-Ti oxide. Nickel powder alloyed with 1–15% by weight of titanium may be used for the manufacture of such an electrode. The total percentage of titanium in the electrode should be about 2% by weight. A mixed Ni-Ti oxide is formed at the surface when the surface of such an electrode is oxidised. The method of oxidation is described in more detail hereinafter.

Another method for the production of the surface layer of mixed Ni-Ti oxide provides that pure Ni powder is used as the starting material and addition of the Ti catalyst is brought about by applying a solution of a titanium salt to the Ni surface in such quantity and/or concentration that the total percentage of Ti in the layer of mixed Ni-Ti oxide is about 2–3% by weight. It is particularly convenient to apply the catalytic additive in the form of an aqueous solution of titanyl sulphate ($Ti(SO_4)$-solution).

The quantity of Ni powder required for the production of the supporting Ni lattice may be soaked in such a solution. The electrodes are then pre-pressed cold from the soaked and dried Ni powder and the layer of mixed Ni-Ti oxide is then formed during hot pressing or sintering.

Another possibility is to soak the cold pre-pressed electrode made from pure Ni powder in the solution of titanyl sulphate. The soaked electrode is hot pressed and/or sintered after drying.

Finally the titanyl sulphate solution may also be added to the hot-pressed or sintered electrode by soaking. The electrode is subsequently re-tempered or re-sintered.

The addition of Ti catalyst may also be achieved by means of solutions of other titanium salts, where the solvent need not be water.

The layer of mixed Ni-Ti oxides which covers the internal and external surfaces of the electrode may be produced by tempering the porous Ti-containing Ni electrodes in air or in an atmosphere of $O_2$. The temperature should be 150° C. at minimum and 500° C. at maximum.

The amount of $O_2$ necessary for oxidation can also be made available in that there is used for manufacture of the electrode, nickel powder containing sufficient air or oxygen for the formation of the mixed Ni-Ti oxide layer during hot pressing or sintering of the electrode, carried out at temperatures between 300° and 500° C. In this case the layer of mixed oxides which acts as a catalyst and stabiliser is already produced during hot pressing or sintering in air and the subsequent working processes are thus eliminated.

The time of tempering should be 0.5 hour at minimum. Depending on the nature of the powder, the temperature and the gas atmosphere in which tempering is carried out, the time of tempering may be extended up to 20 hours.

The layer of mixed Ni-Ti oxide may also be produced by other methods, thus, for example, by thermal decomposition of a surface layer of $NiTi_x(OH)_2$, applied chemically or electrochemically, at temperatures above 150° C.

The mixed Ni-Ti oxide layer which acts as a catalyst and stabiliser should have a minimum thickness of 0.0025–0.1 μm (10 to 100 molecular layers) in order to guarantee a dense close cover of the supporting Ni lattice of the electrode.

The following effects are produced by means of the titanium active as a promoting catalyst which is present in the finely divided Ni-Ti oxide and/or alloy components of the nickel at its surface, in particular:

- the over-potential for the liberation of $H_2$ is reduced significantly;
- the continuing electrochemical oxidation of the Ni metal of the $O_2$-anodes to $\alpha$-$3Ni(OH)_2.2\,H_2O$ and/or $\beta$-$4NiOOH.3H_2O$ is significantly impeded.

Thus the electrode according to the invention is resistant, even in long term operation, to the most powerful known oxidising agent, namely oxygen in the nascent state, and is thus superior, as an electrode for the electrolysis of water, to platinum which is also excluded from use for reasons of economy.

On the basis of the properties described hereinbefore, electrodes according to the invention are particularly well suited for use in modern electroysers such as, for example, the ELOFLUX-water electrolysis cell. In this case they may be used both as anode and as cathode.

The object of decreasing the polarisation produced in the liberation of $H_2$ and $O_2$ and the prevention of continuing oxidation of nickel is solved according to the invention without the use of rare or expensive metals, such, for example, as platinum.

DESCRIPTION OF THE PREFERRED EMBODIMENTS

The manufacture of an electrode according to the invention is described in detail in the following by means of examples.

EXAMPLE 1

11.76 g of carbonyl nickel powder (carbonyl nickel T 255; particle size range <50 μm) was soaked in an aqueous solution of titanyl sulphate in such a way that an amount of 0.24 g (corresponding to 2% by weight for a total electrode weight of 12 g) of Ti catalyst was added to the carbonyl nickel powder. Soaking of the carbonyl nickel powder took place with continuous stirring in order to produce good mixing of the nickel powder with the aqueous titanyl sulphate solution. After drying the soaked carbonyl nickel powder, it was mixed with 4 g of salt filler ($Na_2CO_3$; particle size range 50–75 μm) in order to produce the necessary macro or volume porosity, packed smoothly into a matrix of 40 mm internal diameter, pre-pressed cold with 0.32 tonne/cm$^2$ and, after heating in air, hot-pressed at 400° C. with 0.8 tonne/cm$^2$ to give a disc-shaped electrode. After the pressing process the added salt filler was dissolved out with hot distilled water.

EXAMPLE 2

11.76 g of carbonyl nickel powder (carbonyl nickel T 255; particle size range <50 μm) was mixed with 4 g of salt filler ($Na_2CO_3$; particle size range 50–75 μm), packed smoothly into a matrix of 40 mm internal diameter, cold pre-pressed with 0.32 tonne/cm$^2$ and, after heating in air to 400° C. with 0.8 tonne/cm$^2$ simultaneously hot-pressed to form a disc-shaped electrode. After the pressing process the added salt filler was again dissolved out in hot water and the electrode dried. Subsequently the porous Ni electrode was treated with an aqueous solution of titanyl sulphate containing 0.24 g of Ti, dired and tempered for 4 hours at 200° C. in order to form mixed Ni-Ti oxide on the internal surface.

EXAMPLE 3

The manufacture of an electrode to be used as anode takes place as in Example 1, but the hot pressing is carried out in a gas-tight steel mould with negligible entry of air. After dissolving out the salt filler, the electrode was dried and tempered for 10 hours in air at 200° C.

A stronger welding of the Ni particles is achieved by hot pressing the electrode with exclusion of air.

In an experiment with an electrode connected as cathode which was manufactured as in Example 1, hydrogen was liberated in 6 N KOH. The stationary characteristic lines (denoted by T 255 TiO ($SO_4$)) measured at 25° and 80° C. are shown in the accompanying diagram. For comparison the diagram shows the stationary characteristic lines measured for carbonyl nickel electrodes prepared under the same conditions without the addition of Ti (denoted by T 255). At 80° C. and 150 mA/cm$^2$, $H_2$ liberation takes place at the pure carbonyl nickel electrode with $\eta=159$ mV, at the electrode catalytically promoted by Ti with $\eta=75$ mV. Thus the use of the mixed Ni-Ti oxide layer, acting as a promoting catalyst, leads to a decrease in the over potential of 84 mV, corresponding to 53%.

In a second experiment (long period experiment) oxygen was liberated from 6 N KOH at T=80° C. and i=200 mA/cm$^2$ at an electrode connected as anode which was manufactured according to Example 1. The potential of the electrode increased very little during the time of operation. During a 1000 hour loading of the $O_2$-anode, with liberation of $0_2$, it increased by only 0.26 mV/hour.

The formula $NiO_x$ is used herein for nickel oxide because nickel oxide occurs in different compositions in which the number, x, of oxygen atoms which combine with one nickel atom can be assumed to have a value up to 2. Typical values of x which have been proved to exist are within the range x=1 to 1.5. Similarly the formula Ni $Ti_x$ $(OH)_2$ has also been used.

What I claim as my invention and desire to secure by Letters Patent of the United States is:

1. A highly porous electrode, hot pressed from nickel powder for alkaline water electrolysers, which is coated on its internal and external surfaces with a layer comprising a mixed Ni-Ti oxide having a thickness of 0.0025–0.1 μm (10–100 Molecular layers).

2. An electrode according to claim 1, in which said nickel powder is alloyed with 1–15% by weight of titanium.

3. An electrode according to claim 2, in which the percentage of titanium in the alloy is approximately 2% by weight.

4. The method of electrolyzing an alkaline water solution using the electrode of claim 1.

5. A method of electrolyzing liquid of the type responsive to electrolysis using a highly porous electrode hot pressed from nickel powder which is coated on its internal and external surfaces with a layer comprising a mixed Ni-Ti oxide having a thickness of 0.0025–0.1 μm (10–100 Molecular layers).

6. A method of manufacturing a highly porous electrode for alkaline water electrolyzers comprising the step of forming an electrode comprising nickel with a mixed nickel-titanium oxide layer on the surfaces thereof utilizing nickel powder as the source of said nickel and an aqueous titanyl sulfate TiO ($SO_4$) solution as the source of said titanium, portions of said solution and said nickel being oxidized to form said layer, said layer being between 0.0025 and 0.1 μm thick, said titanium being approximately 2–3% by weight of said layer.

7. The method according to claim 6, in which the solution is mixed with the nickel powder before pressing the electrode.

8. The method according to claim 6, in which the electrode is cold pre-pressed from nickel powder, is soaked with the solution and is then hot pressed.

9. The method according to claim 6, in which the electrode is cold pre-pressed from nickel powder, is soaked with the solution and is then sintered.

10. The method according to claim 6, in which the electrode is hot-pressed from nickel powder, is soaked with the solution and is subsequently tempered.

* * * * *